US005194901A

United States Patent [19]

Fukushima et al.

[11] Patent Number: 5,194,901

[45] Date of Patent: Mar. 16, 1993

[54] IMAGE FORMING APPARATUS HAVING MEANS FOR PREVENTING TONER DEPOSIT ON PHOTOSENSITIVE MEMBER

[75] Inventors: Satoru Fukushima, Tokyo; Kenichi Takeda, Yokohama, both of Japan

[73] Assignee: Canon Kabushiki Kaisha, Tokyo, Japan

[21] Appl. No.: 718,287

[22] Filed: Jun. 20, 1991

[30] Foreign Application Priority Data

Jun. 21, 1990 [JP] Japan ..... 2-163395

[51] Int. Cl.[5] ..... G03G 15/14

[52] U.S. Cl. ..... 355/273; 355/219; 355/326

[58] Field of Search ..... 355/272, 273, 274, 271, 355/326, 218, 219

[56] References Cited

U.S. PATENT DOCUMENTS

| | | | |
|---|---|---|---|
| 4,914,737 | 4/1990 | Amemiya et al. | 355/274 X |
| 5,049,934 | 9/1991 | Saito | 355/219 |
| 5,083,167 | 1/1992 | Fukushima et al. | 355/274 |

*Primary Examiner*—A. T. Grimley
*Assistant Examiner*—Nestor R. Ramirez
*Attorney, Agent, or Firm*—Fitzpatrick, Cella, Harper & Scinto

[57] ABSTRACT

An image forming apparatus includes a movable photosensitive member; a toner image forming device for forming a toner image on the photosensitive member; a transfer device for electrostatically transferring the toner image from the photosensitive member to a transfer material at a transfer position; and a transfer material carrying member for carrying the transfer material to feed the transfer material to the transfer position. The transfer device transfers the image while the transfer material is on the transfer material carrying member, and after the image is transferred, the transfer material having the toner image transferred thereon and carried on the transfer material carrying member is contacted to the photosensitive member. There is also provided a charger for charging the photosensitive member, wherein at least a part of the photosensitive member making the contact is charged by the charger in a period between its passage through the transfer position and the contact, so as to be given an electric potential at which the toner image forming device does not deposit the toner to the photosensitive member.

26 Claims, 12 Drawing Sheets

IMAGE FORMING APPARATUS HAVING MEANS FOR PREVENTING TONER DEPOSIT ON PHOTOSENSITIVE MEMBER

FIELD OF THE INVENTION AND RELATED ART

The present invention relates to an image forming apparatus of an electrophotographic type, and electrostatic recording type or the like, more particularly to an image forming apparatus usable as a multi-color electrophotographic copying apparatus having plural developing devices, a color printer or copying machine for a facsimile machine, an output terminal of a computer or the like.

Various types of multi-color electrophotographic machines have been proposed. First, the description will be made as to a typical full-color image formation process. A surface of a photosensitive drum is uniformly charged by a charger, and thereafter is exposed to image light, so that an electrostatic latent image is formed. The latent image is developed by a developing device containing a developer of a predetermined color into a toner image, which is then carried to an image transfer station by rotation of the photosensitive drum. At the transfer station, the toner image is transferred onto a transfer material which has been supplied and carried on a transfer material carrying sheet of a transfer drum. The image is transferred onto the transfer material by the transfer charger. After the first color image is thus transferred, the transfer drum rotates through one full-turn (idle rotation) until the second color image transfer starts. The transfer material having the first color toner image and carrier on the transfer material carrying sheet is brought into contact with the non-latentimage area of the photosensitive drum surface. The period of the idle rotation is used for movement of an optical system or the developing device to make proper motions between the first color image formation and the second color image formation.

The image formation, the transfer process and the idle rotation process are repeated for the plural color image transfers, so that a toner image constituted by multi-color images superposed, is formed.

The experiments and investigations by the inventors have revealed problems arising, particularly when the transfer material carrying sheet of the transfer drum is made of polyvinylidene fluoride film or the like, and the transfer material P is made of paper, and particularly when the ambient humidity is high.

Referring to FIG. 5, the problem will be described. After the transfer material P on the transfer drum 5 receives a first color toner image T, the transfer material P now having the toner image T is still retained on the transfer drum 5. It is rotated together with the transfer drum 5 for preparation of the transfer of the second color image. FIG. 5 shows the electric charge on the transfer material P at its trailing end Pa at this time. In this example, the electrostatic latent image is formed by negative charge; and the toner is charged to the negative polarity for the purpose of reverse development, and therefore, the transfer voltage supplied to the transfer charger 5*b* has a positive polarity. An outside discharger 5*e* and an inside discharger 5*d* are disposed to face each other across the transfer drum 5 at the outside and inside of the transfer drum 5, respectively, immediately downstream of the transfer position where the transfer charger 5*b* is faced to the photosensitive drum 1, with respect to the peripheral movement direction of the transfer drum 5. The outside charger 5*e* is supplied with an AC voltage; and the inside charger 5*d* is supplied with an AC voltage biased with a DC voltage having a polarity opposite from the charging polarity of the transfer charger.

In the example, a polyvinylidene fluoride film is used as the transfer material carrying sheet 501 of the transfer drum 5 with a sheet of paper as the transfer material P. The volume resistivity of the polyvinylidene fluoride resin film is $10^{13}$ ohm.cm, and the volume resistivity of the transfer sheet is $10^{9}$ (at high humidity condition of 85 %RH)-$10^{12}$ (low humidity condition of 10 %RH) ohm.cm. It has been found that when such materials are used, the positive charge is injected from the transfer charger 5*b* into the transfer material P through the transfer material carrying sheet 501, particularly at the high humidity condition, and the positive charge is accumulated in the surface region of the trailing edge Pa of the transfer material P.

It has also been found by the inventors that the positive charge accumulated in the surface of the trailing edge Pa of the transfer material forms a strong electric field between the surface of the photosensitive drum, and that, as shown in FIG. 6, when the trailing edge Pa is separated from the photosensitive drum 1, the separation discharge occurs. Then, the negative charge in the air is attracted by the positive charge of the transfer material P and moves to the transfer material. However, the positive charge in the air moves to the photosensitive drum 1 having the negative charge, with the result that the photosensitive drum 1 is damaged, in other words, an image transfer memory is retained in the photosensitive drum 1. The memory of the photosensitive drum 1 is not easily erased even by exposing the photosensitive drum 1 to light. Additionally, even if the photosensitive drum 1 is subjected to the negative charge, the amount of charge reduces in the memory region in the form of stripes along the width of the photosensitive drum 1. This prevents uniform charging of the photosensitive drum 1, and therefore, non-uniformity of the image results.

Conventionally, and therefore, even if the memory region of the photosensitive drum 1 is discharged by exposure to light or is subjected to the charging by the primary charger for the image formation, after the first color image is transferred onto the transfer material P from the photosensitive drum during the transfer step, the potential distribution remains in accordance with the memory, and the memory is developed. Therefore, if the memory region exists in the region of the photosensitive drum that contacts the transfer material already having the transferred toner image during the transfer process being performed, such as during the idle rotation, the toner image corresponding to the memory region developed is transferred onto the transfer material, with the result of non-uniform resultant image.

The memory particularly occurs when the photosensitive drum has a surface organic photoconductive layer.

SUMMARY OF THE INVENTION

Accordingly, it is a principal object of the present invention to provide an image forming apparatus wherein the non-uniformity of the image due to the transfer memory on the photosensitive drum is prevented to provide high quality images.

It is another object of the present invention to provide an image forming apparatus capable of forming good images under substantially all conditions under which the apparatus is operated.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 3:
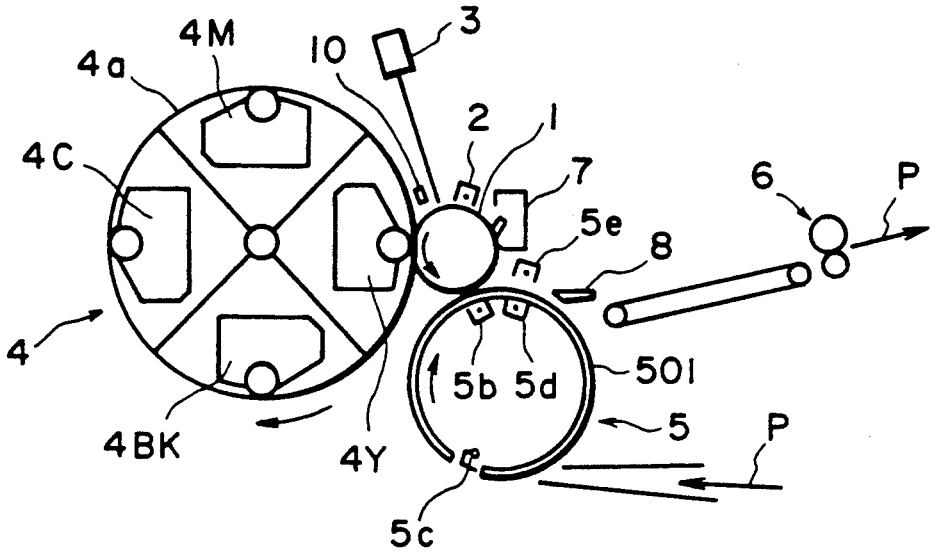
FIG. 3 is a sectional view of a multi-color electrophotographic copying apparatus to which the present invention is applicable.

Referring first to FIG. 3, there is shown a multi-color electrophotographic copying machine as an exemplary image forming apparatus according to an embodiment of the present invention.

The copying apparatus comprises an image bearing member in the form of a photosensitive drum 1 supported for rotation about an axis in a direction indicated by an arrow. Around the photosensitive drum 1, there are disposed image forming means. The image forming means may be of any known type. In this example, it includes a primary charger 2 for uniformly charging the photosensitive drum 1, exposure means 3 in the form of a laser beam exposure device, for example, for exposing the photosensitive drum 1 to a color separated light image in accordance with image information such as an image on an original document to form an electrostatic latent image on the photosensitive drum 1, and a rotary type developing device 4 for visualizing the electrostatic latent image on the photosensitive drum 1.

The rotary type developing device 4 includes four developing devices 4Y, 4M, 4C and 4BK containing four color developers, i.e., a yellow developer, a magenta developer, a cyan developer and a black developer, and a cylinder **4*a* rotatably supported and supporting the developing devices 4Y, 4M, 4C and 4BK. The rotary type developing device 4 rotates a desired one of the developing devices a position facing the outer peripheral surface of the photosensitive drum 1 by rotation of the cylinder 4*a* to develop the electrostatic latent image on the photosensitive drum 1. By one full turn of the cylinder 4*a***, a full-color development in four colors is effected.

Figure 4:
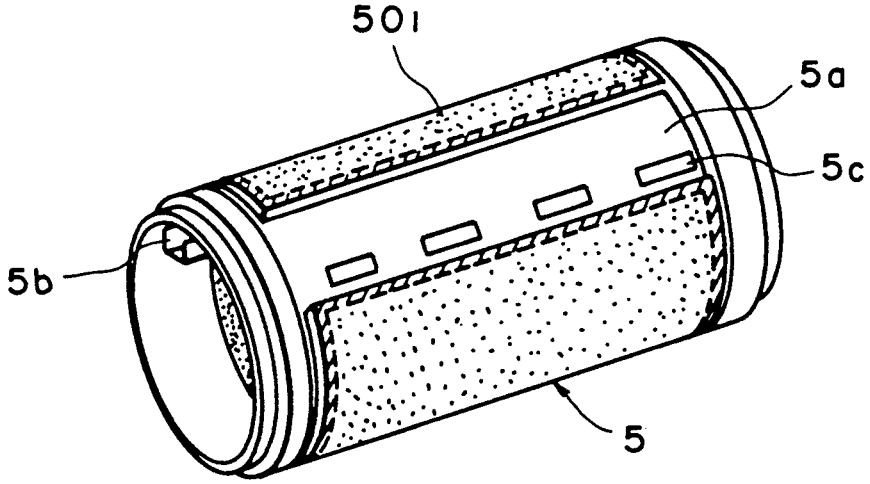
FIG. 4 is a perspective view of an image transfer device used in the image forming apparatus of FIG. 3.
Figure 5:
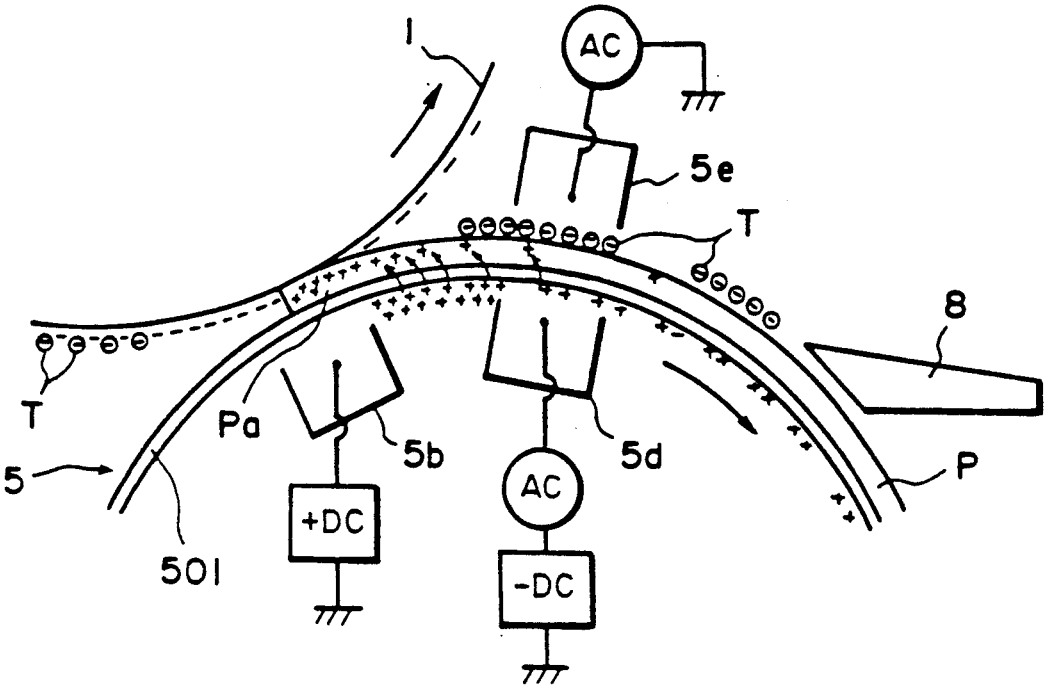
FIG. 5 PRIOR ART
FIGS. 5 and 6 are sectional views illustrating movement of electric charge during the transfer operation in the apparatus of FIG. 3.
Figure 6:
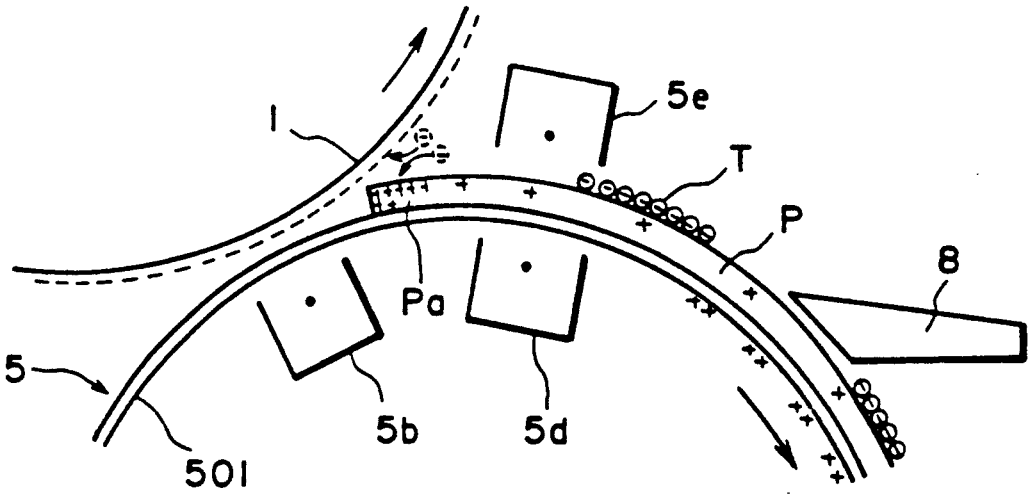
FIG. 6 PRIOR ART

The visualized image on the photosensitive drum 1, that is, the toner image is transferred onto the transfer material P carried on and supplied by a transfer device 5 (transfer material carrying means). In this example, the transfer device 5 includes a rotatably supported transfer drum 5 which, as shown in FIGS. 3 and 4, comprises a cylinder **5*a* having opposite rings and a connecting portion connecting the rings, a transfer charger 5*b* functioning as transfer means in the cylinder 5*a*, a transfer material gripper 5*c* for gripping the transfer material supplied by an unshown sheet feeding device. An inside discharging charger 5*d* and an outside discharging charger 5*e* which constitute discharging means are disposed inside and outside the transfer drum 5, respectively. The opening of the cylinder 5*a* is covered with a transfer material carrying sheet 501 stretched thereover. The transfer material carrying sheet 502** is usually made of polyethylene terephthalate film or polyvinylidene fluoride resin film or the like.

In full-color image forming operation, the first primary charger 2 and the image exposure means 3 are operated to form a cyan color component latent image on the outer surface of the photosensitive drum 1. The electrostatic latent image is developed with a first color developer (yellow) accommodated in the developing device 4Y. The transfer material P supplied to the transfer drum 5 is gripped by a gripper **5*c*. The transfer material P is contacted to the yellow toner image on the photosensitive drum during rotation of the transfer drum 5 in the image transfer process. The toner image is transferred onto the transfer material P by the transfer charger 5*b*, and simultaneously, the transfer material P is securedly attracted on the transfer material carrying sheet 501**.

During the period after the completion of the yellow color image transfer and before the start of the second color image transfer, the transfer drum 5 rotates through one full-turn idly. In this period, the transfer material P having the yellow toner image on the transfer material carrying sheet 501 is contacted to the electrostatic latent image non-formation area on the surface of the photosensitive drum 1. The non-formation region is a region on the photosensitive drum in which no electrostatic latent image is formed when any image formation is applied on the photosensitive drum 1, even when the region extends downstream of the exposure position with respect to a movement direction of the surface of the photosensitive drum 1. During the idle rotation, the optical system for reading image information and the developing device is moved for preparation of the second color image formation. The yellow toner image on the transfer material P is contacted to the photosensitive drum 1 during the idle rotation, and the toner image is retained on the transfer material P by the operation of the transfer charger **5*b***.

The image forming operation, the image transfer operation and the idle rotation are carried out for each of the magenta, cyan and black images. Until completion of the four color image transfers, the transfer charger **5*b* is repeatedly operated. After completion of the superposed image transfers of the four color visualized images onto the transfer material P, the transfer material P is electrically discharged by the inside charger 5*d* and the outside charger 5*e*. Thereafter, the transfer material P is separated from the transfer material 5 and is subjected to an image fixing operation by a heat roller fixing device 6. Finally, the transfer material P now having a fixed full-color image is discharged to the outside of the apparatus. The residual toner remaining on the photosensitive drum 1 is removed by a cleaner 7, and the photosensitive drum 1** is electrically discharged by a discharging lamp, so that it is prepared for the next image formation process.

In this embodiment, the diameter of the photosensitive drum 1 is 80 mm, and that of the transfer drum 5 is 160 mm (twice the diameter of the photosensitive drum 1). The photosensitive drum 1 has a surface organic photoconductive layer having a negative charging property and is rotated at a peripheral speed of 160 mm/sec in the direction indicated by an arrow. After the surface thereof is discharged by the discharging lamp 9, the surface is charged to a potential of −300−−900 V by the primary charger. The surface potential of the photosensitive drum 1 is monitored by a drum surface potential sensor 10, and a proper surface potential is determined.

Each of the developing devices of the rotary developing device 4 contains the toner electrically charged to a polarity which is the same as the charging polarity of the photosensitive drum 1 The toner is deposited onto a low potential portion of the electrostatic latent image on the photosensitive drum 1 by a developing electric field which is provided by the potential of the photosensitive drum 1 and a developing bias voltage applied to a developing sleeve for carrying the toner to the developing zone where the developing sleeve is disposed close to the photosensitive drum 1. Thus, the latent image is developed and visualized.

Figure 1:
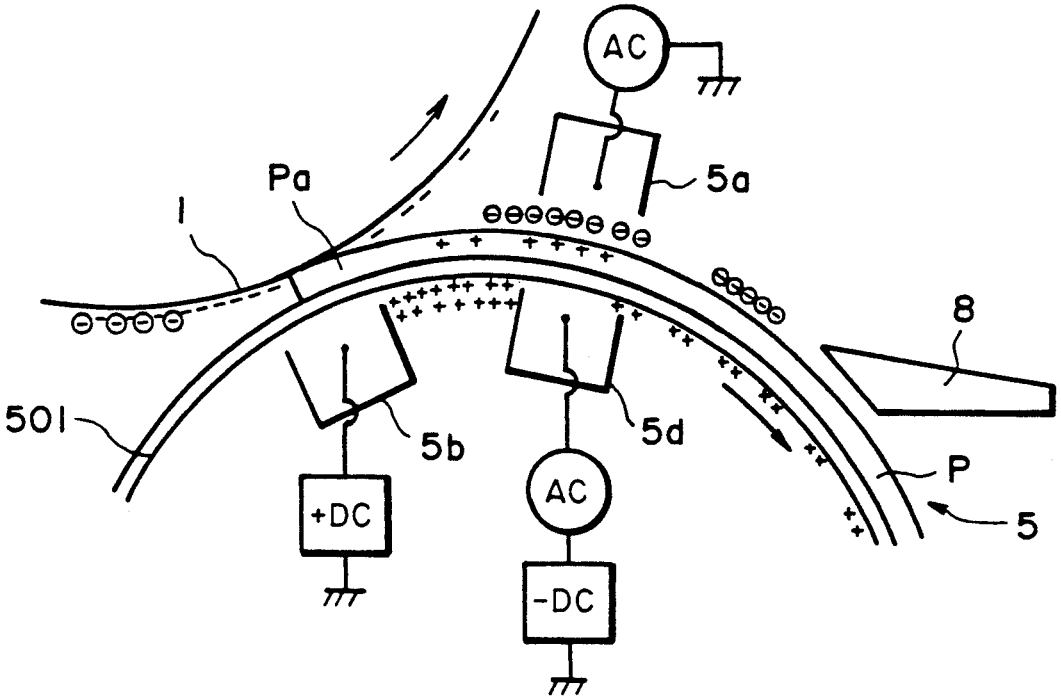
FIG. 1 is a sectional view of an image forming apparatus in the neighborhood of an image transfer station, according to an embodiment of the present invention.

FIG. 1 is a sectional view of the image forming apparatus of FIG. 3 around the transfer station. In this embodiment, the transfer material carrying sheet 501 is of polyvinylidene fluoride resin film (dielectric material) having a thickness of 100– 175 microns and a volume resistivity of $10^{13}$ ohm.cm. The transfer charger **5*b* is a corona charger having a charging polarity which is opposite from the charging polarity of the toner and of the photosensitive drum 1. The transfer charger 5*b* is supplied with a voltage of +6 KV−+9 KV, so that the transfer current is +100 micro-ampere −+500 microamper. The visualized image or toner image on the photosensitive drum 1 is transferred onto the transfer material P supplied to the transfer station on the transfer drum 5**.

Figure 2A:
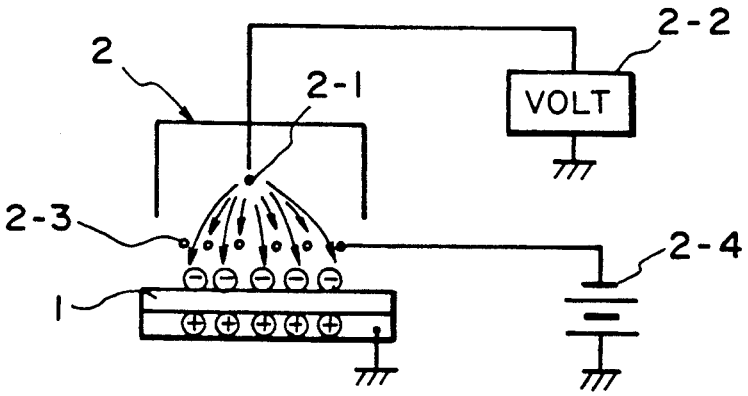
FIG. 2A illustrates a scorotron type charging means used in an image forming apparatus according to an embodiment of the present invention

In this embodiment, as shown in FIG. 2A, the primary charger 2 is of a scorotron type supplied with a high voltage from a high voltage source 2-2. The voltage is supplied particularly to the charging wire 2-1, and the amount of electric discharge is controlled by application of a control voltage to a grid wire 2-3 from a grid bias source 2-4. By doing so, the surface of the photosensitive drum 1 is charged to a desired potential.

In the multi-color electrophotographic copying apparatus having the structure described above, the output voltage of the grid bias voltage source 2-4 is increased for the electrostatic latent image non-formation area of the photosensitive drum 1, that is, for example, the area facing the scorotron 2 after completion of the electrostatic latent image by the first color image exposure and before the start of the second color electrostatic latent image formation. By doing so, the amount of charge on the surface of the photosensitive drum 1 by the primary charger 2 is made larger than that in the electrostatic latent image formation area. Therefore, the potential of the photosensitive drum surface in the electrostatic latent image non-formation region is higher than that in the electrostatic latent image formation region. In this embodiment, the latent image non-formation region charged to a potential higher than that in the latent image formation region by the primary charger 2, is uniformly exposed to light by the laser beam exposure means 3.

Figure 7:
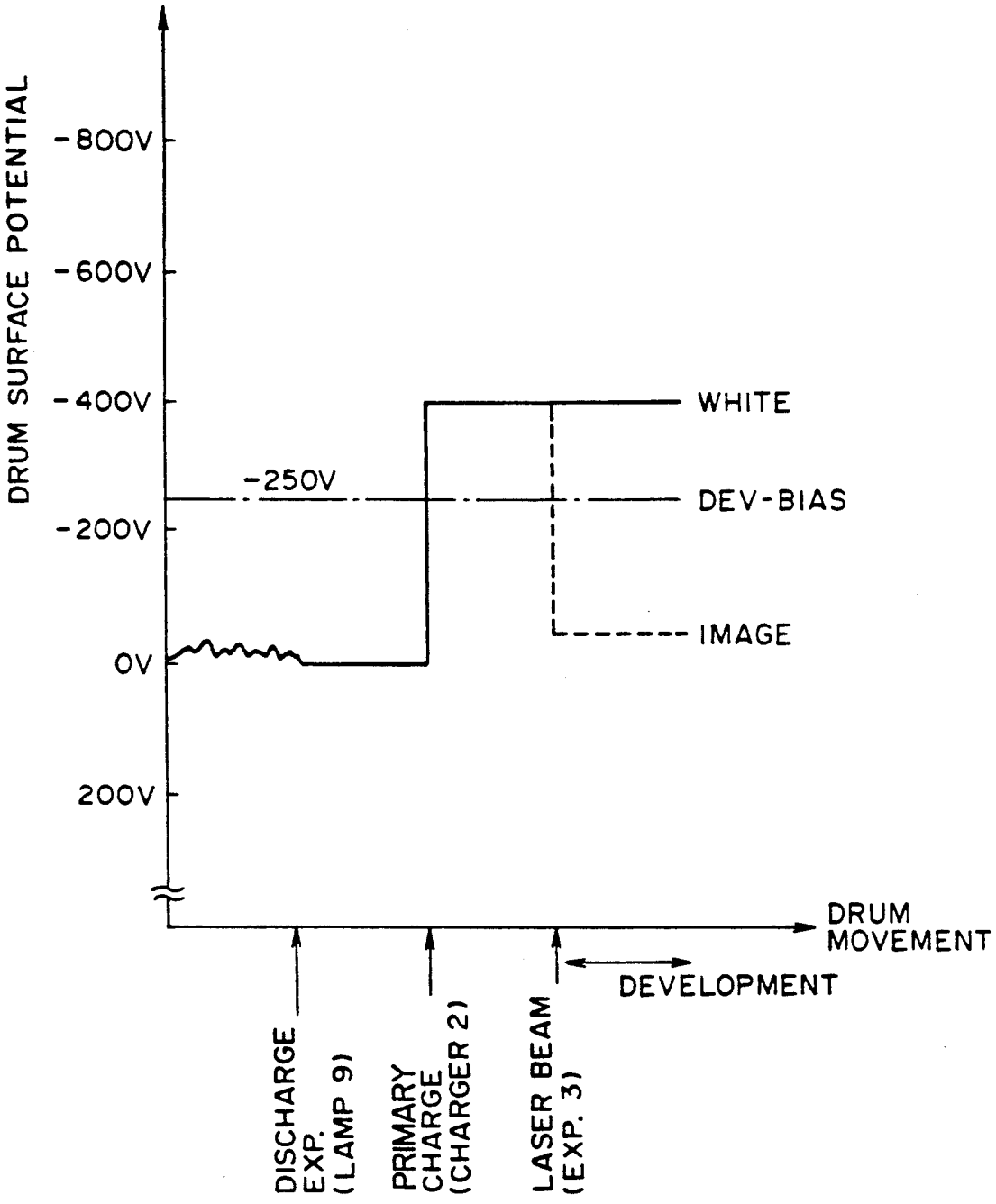
FIG. 7 is a graph surface showing a change of surface potential in an electrostatic latent image formation region of a photosensitive drum in an image forming apparatus according to a further embodiment of the present invention.

FIG. 7 shows a change of a surface potential of the latent image formation region of the photosensitive drum 1. The latent image formation region is a region in which an electrostatic latent image is formed on the photosensitive drum after exposure thereof to the beam from the laser beam exposure device 3. As will be understood from FIG. 7, in the left of "laser beam exposure", the latent image formation region does not have the electrostatic latent image as yet.

After the image transfer process, the photosensitive drum 1 having residual electric charge is electrically discharged by the discharging lamp 9 so that the surface potential thereof becomes substantially 0 V. Thereafter, it is uniformly charged to a potential of −400 V by the primary charger 2. The developing bias for providing the developing electric field is set −250 V. The difference 150 V between the charge potential of the photosensitive drum 1 of −400 V and the developing bias voltage of −250 V is a fog removing voltage effective to prevent the toner from depositing on the background area of the image. Because of the electric field provided by the potential difference, the toner is normally attracted to the developing sleeve, and is prevented from depositing on the photosensitive drum 1, and therefore, the resultant image does not have the toner in the background area of the image (white portion). On the other hand, the area of the photosensitive drum 1 corresponding to the image pattern is illuminated by the laser beam at a light intensity corresponding to the image density by a laser beam exposure device 3. Therefore, the potential of the portion exposed to the laser beam lowers beyond the developing bias voltage By the electric field provided by the developing bias voltage and the surface potential of the photosensitive drum at the exposed area, the toner is deposited on the photosensitive drum 1, so that a toner image is formed. In FIG. 7, the broken line represent the portion having the surface potential of −50 V to which the potential is lowered by the image exposure.

Figure 8:
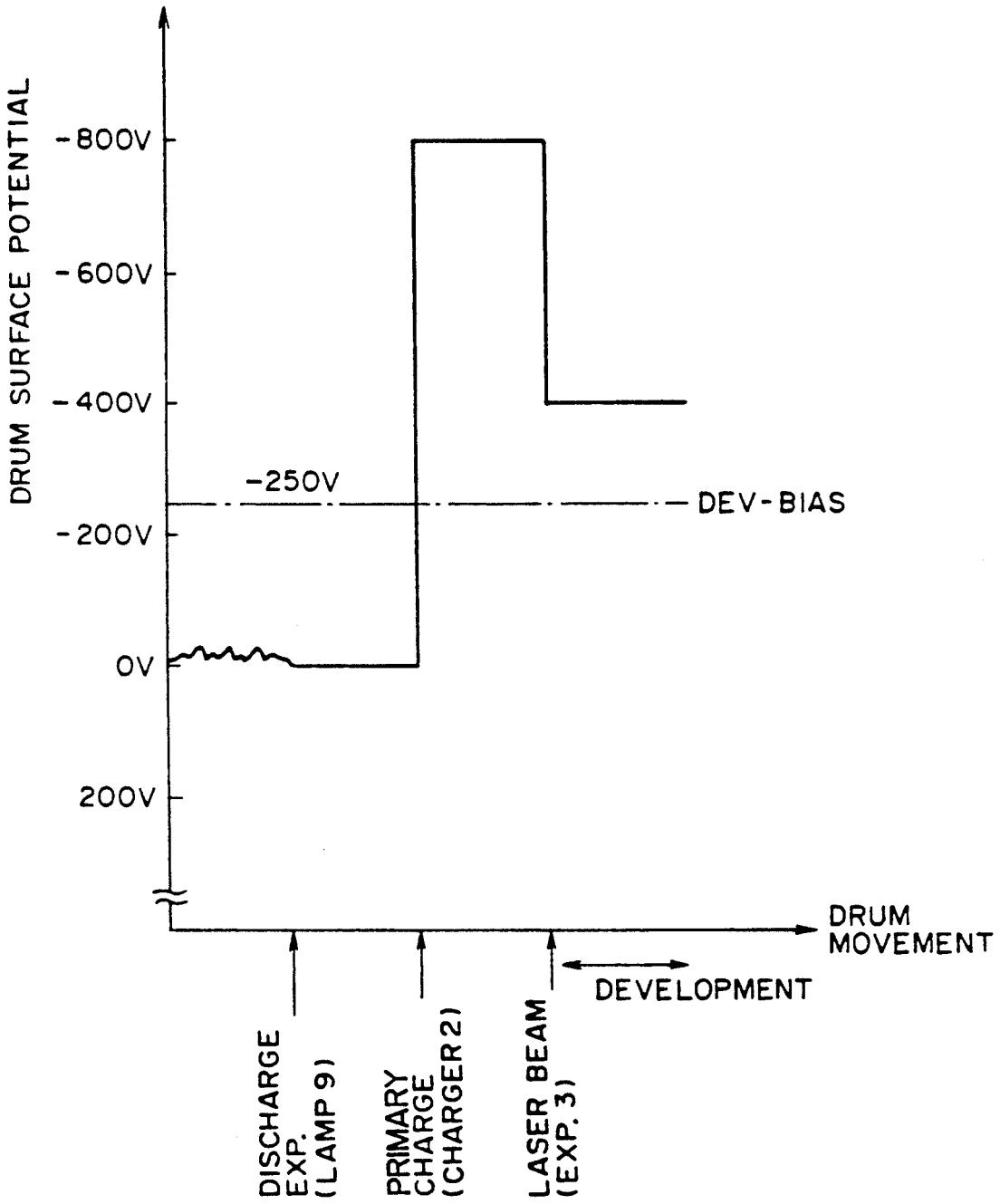
FIG. 8 is a graph showing a change of a surface potential of an electrostatic latent image non-formation area of the photosensitive drum in the apparatus of the first embodiment.

FIG. 8 shows a change of the surface potential in the electrostatic latent image non-formation area on the photosensitive drum 1. The photosensitive drum 1 having the residual charge after the image transfer is electrically discharged by the discharging lamp 9 so that the surface potential thereof becomes substantially 0 V. Thereafter, it is charged to a surface potential of −800 V which is higher than that in the latent image formation region, by the primary charger 2 Then, it is exposed to the laser beam from the laser beam exposure means 3, by which the surface potential lowers to −400 V.

Figure 9:
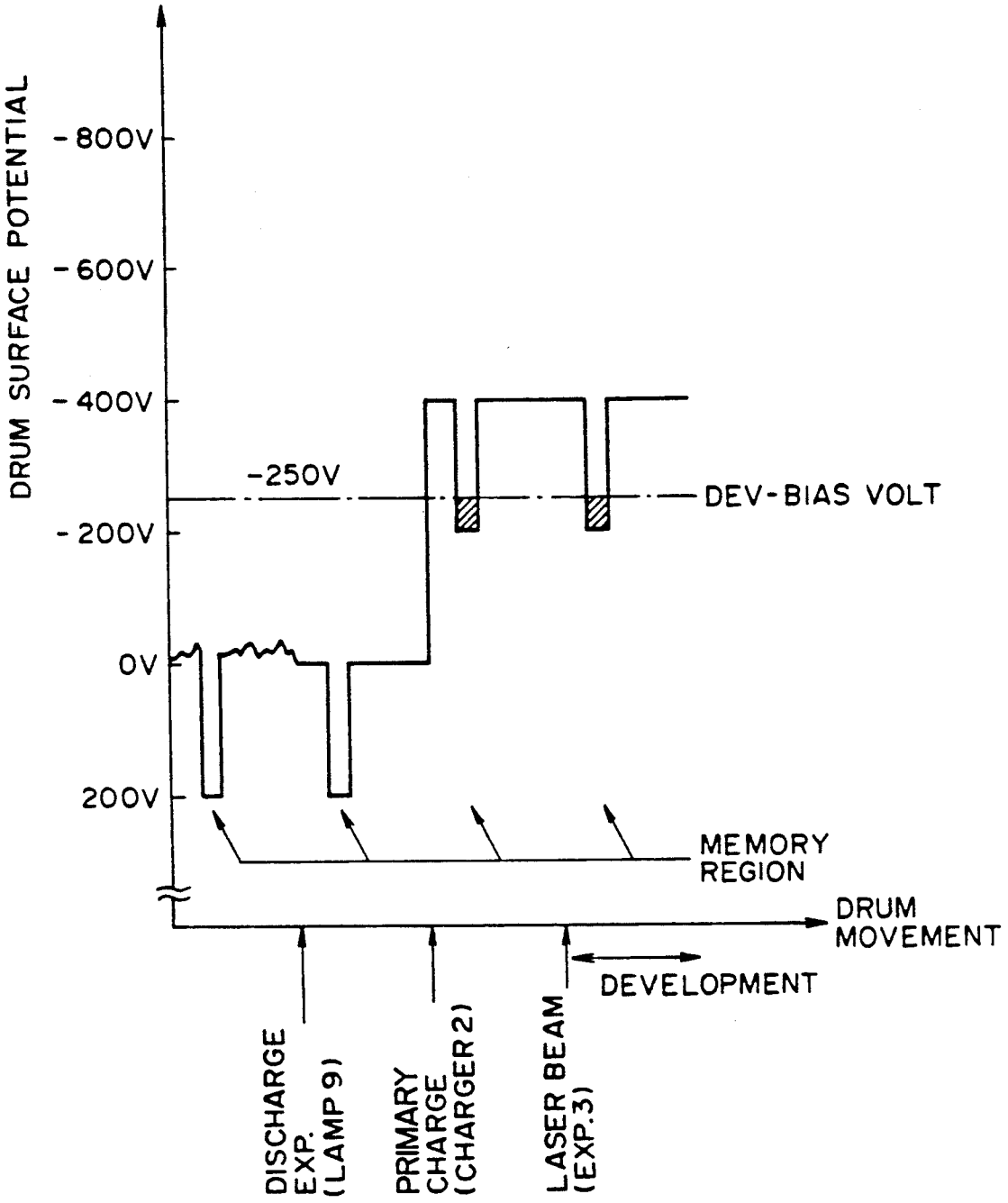
FIG. 9 PRIOR ART
FIG. 9 is a graph showing a change of the surface potential of an electrostatic latent image non-formation area having memory region in a photosensitive drum in an image forming apparatus.

FIG. 9 shows a change of a surface potential when the same primary charging as for the latent image formation region is effected to the latent image non-formation region. The non-formation region is contacted to the transfer material P having the toner image on the transfer drum 5, during the idle rotation. As will be understood from FIG. 9, the potential of the memory region (approximately 200 V) remains even after the photosensitive drum 1 is electrically discharged. When the photosensitive drum 1 is charged by the primary charger to −400 V, the potential of the memory region becomes approximately −200 V. Therefore, in the memory region, the developing electric field is provided by the potential difference of approximately 50 V (hatched portion in the Figure), which is the difference between the memory region potential (−200 V) and the developing bias voltage (−250 V). In the conventional apparatus, the potential distribution appears by the memory where the electrostatic latent image is not formed In the low potential portion, the toner is deposited. As a result, during the idle rotation (non-transfer duration), the transfer material having the toner image and carried on the transfer drum 5 is brought into contact with a region of the photosensitive drum 1, at least a part of which is the memory region, and therefore, the toner deposited on the photosensitive drum 1 due to the memory is transferred onto the transfer material P with the result of a non-uniform image.

Figure 10:
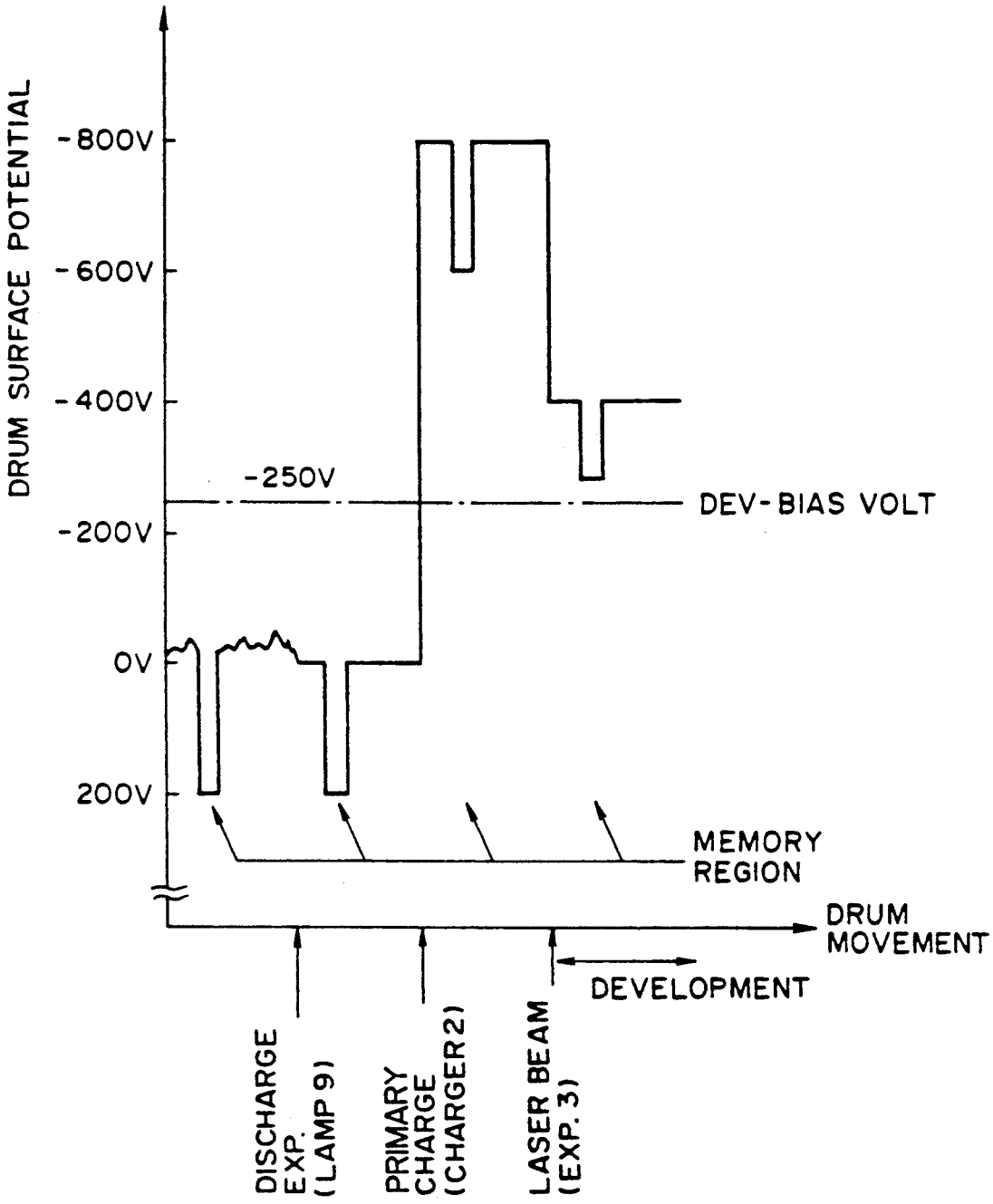
FIG. 10 is a graph showing a change of a surface potential of an electrostatic latent image non-formation area having a memory region on a photosensitive drum in the apparatus of the first embodiment.

FIG. 10 is a graph showing a change of the surface potential when the present invention is used, that is, when the electrostatic latent image non-formation region of the photosensitive drum 1 having the memory region is subjected to the primary charging with a potential higher than that for the latent image formation region The latent image non-formation region is contacted to the transfer material P having the toner image during the idle rotation. In this embodiment, the surface of the photosensitive drum 1 has been subjected to the primary charging, and the surface potential of the latent image non-formation region is −800 V which is higher than the potential of the latent image formation region. Therefore, as will be understood from the Figure, the potential in the memory region is approximately −600 V. Then, the non-formation region is uniformly exposed to light by the laser beam exposure means 3 to lower the surface potential (−800 V) in the uniformly charged region to −400 V similarly to the conventional example. The surface potential of the memory region lowers only to −290 V. The voltage level of −290 V is higher than −250 V which is the developing bias voltage, and therefore, no developing electric field is formed. For this reason, the disturbance of the image due to the toner deposited on the memory region and then deposited to the transfer material P during the idle rotation of the transfer drum 5.

The problem arises from the fact that the lowering degrees of the surface potential are different even by the same amount of exposure because of the potential difference before the exposure in the uniformly charged region without memory than the memory region.

Figure 11:
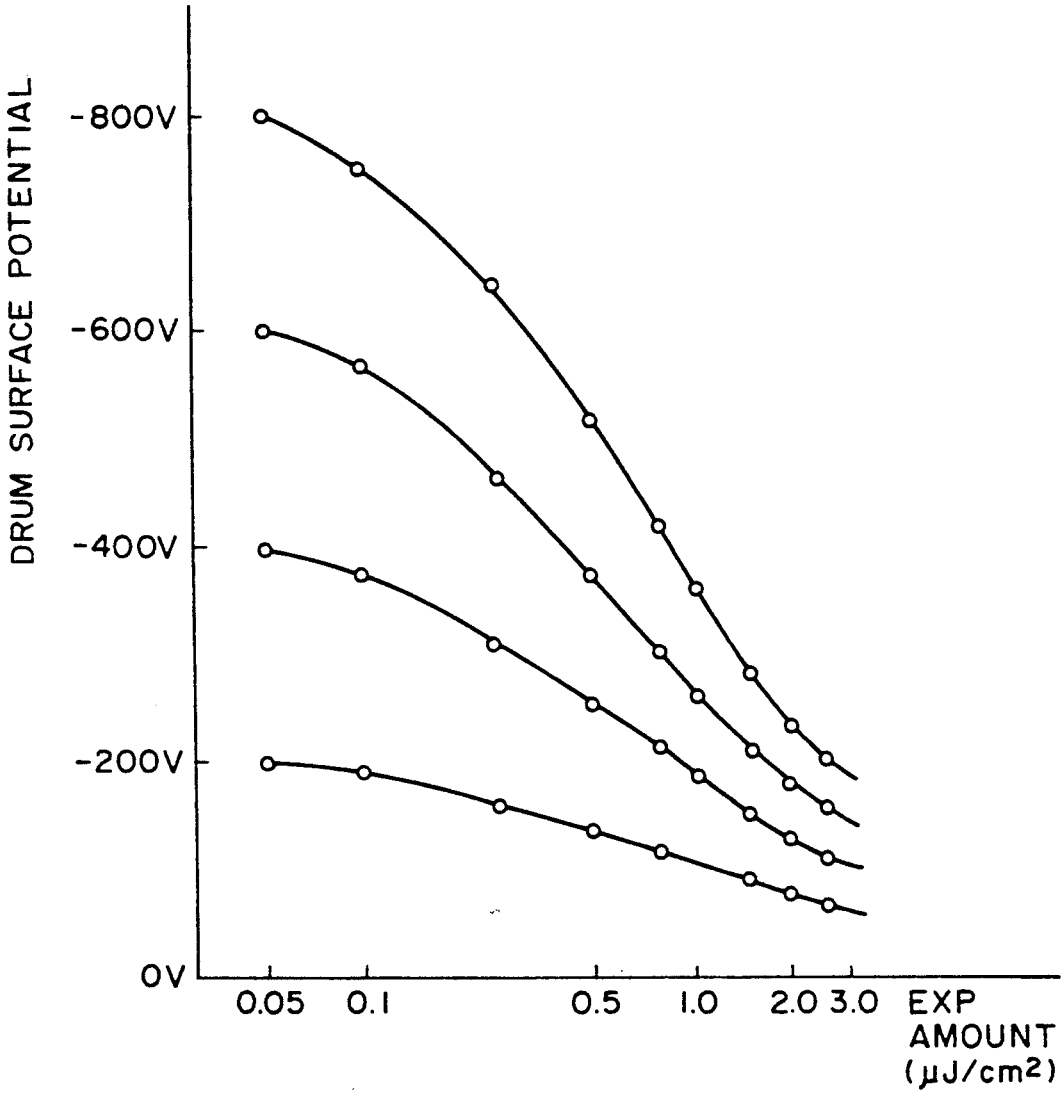
FIG. 11 is a graph showing a relation between a surface potential and amount of exposure of a photosensitive drum used in an image forming apparatus according to an embodiment of the present invention.

FIG. 11 shows the relation between the surface potential and the amount of exposure of the photosensitive drum 1 having the organic photoconductor used in this embodiment. As will be understood from this Figure, even if the amount of exposure is kept constant, the degree of the potential lowering by the exposure increases with increase of the surface potential before the exposure It is also understood from this Figure that if the amount of exposure is such that the surface potential of −800 V before the exposure lowers to −400 V after the exposure, the surface potential of −600 V before the exposure lowers only to −290 V after the exposure. Thus, the potential lowering of the memory region beyond that of the nonmemory region decreases so that it remains higher than the developing bias voltage (−250 V), and therefore, the developing electric field is not formed in the memory region. Therefore, the toner is prevented from being deposited on the memory region, so that even if the memory region contacts the transfer material P which is carried on the photosensitive drum 5 during the idle rotation, the image non-uniformity does not occur.

Figure 13:
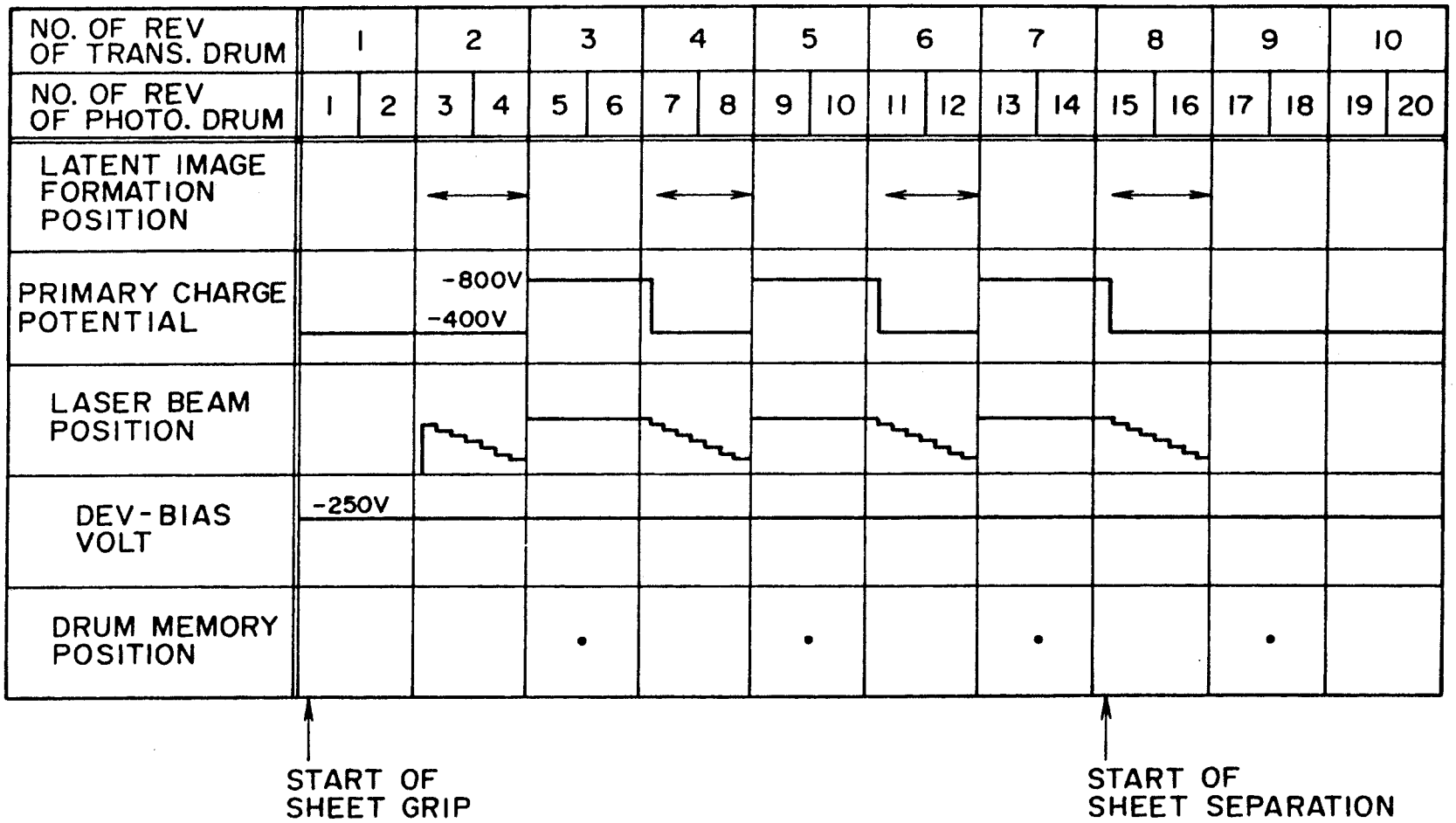
FIG. 13 illustrates operational sequence corresponding to the positions of the photosensitive drum and the transfer drum in the apparatus of the first embodiment of the present invention.

FIG. 13 shows operational sequence including a primary charging, laser beam exposure or the like for each rotation corresponding to the positions of the photosensitive drum and the transfer drum in this embodiment. In this Figure, the time required for a certain position of the photosensitive drum moves from the primary charger position to the developing device position through the exposure position, and the same abscissa position means the same position of the photosensitive drum 5. The potential by the primary charging in the memory region is omitted.

Figure 12:
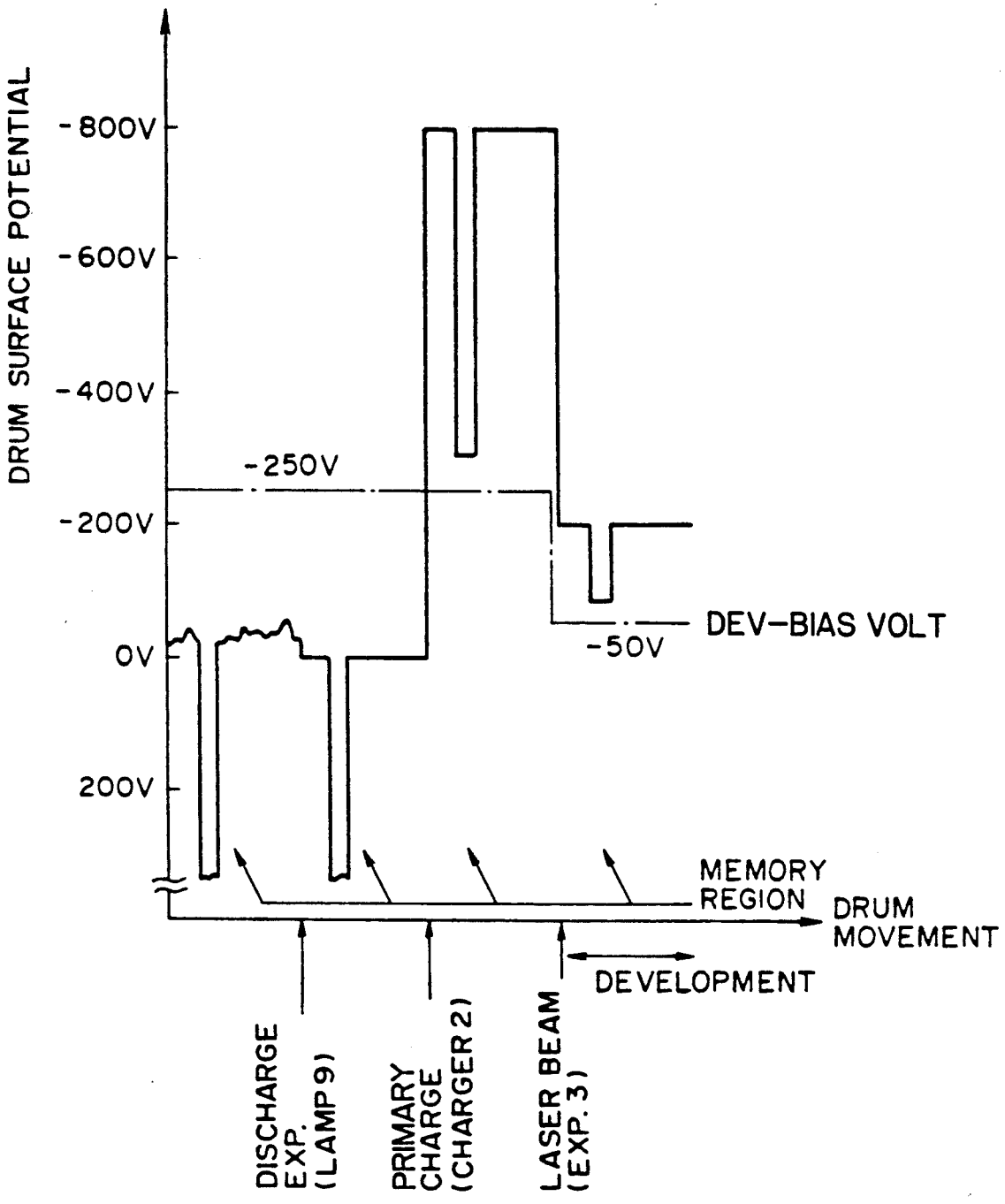
FIG. 12 shows a change of a surface potential of an electrostatic latent image non-formation region having a memory area on a photosensitive drum in an image forming apparatus according to the second embodiment of the present invention.

FIG. 12 shows a change of a surface potential of electrostatic latent image non-formation region of the photosensitive drum 1 which has a memory region. The image non-formation region is brought into contact with the transfer material P having the toner image and carried on the transfer drum 5, during the idle rotation of the transfer drum 5. In this embodiment, after the residual charge is removed by the discharging lamp 9, the latent image non-formation region of the photosensitive drum 1 is charged by the primary charger so that the region is given a potential which is higher than that in the latent image formation region. Then, it is exposed to the laser beam, by which the surface potential of the latent image non-formation region is lowered to a potential lower than that in the latent image formation region. In addition, the developing bias voltage is lowered to a proper level corresponding to the surface potential after the exposure. The change of the surface potential in the latent image formation region of the photosensitive drum in this embodiment is the same as in the first embodiment, and therefore, it is as shown in FIG. 7.

As shown in FIG. 12, in this embodiment, the surface of the photosensitive drum 1 not having the memory region is discharged by the discharging lamp 9 so that the potential thereof becomes substantially 0 V, and thereafter, the primary charger 2 charges the latent image non-formation region having the memory region so that the non-memory region has −800 V. The potential in the memory region at this time was approximately −300 V. Then, the latent image non-formation region is uniformly exposed to light by the laser beam exposure means 3, by which the surface potential of −800 V in the uniformly charged region (non-memory region) is lowered to −200 V which is lower than −400 V in the latent image formation region. Correspondingly, the developing bias voltage is lowered to −50 V so as to provide a proper fog preventing voltage. By the exposure, the surface potential of the memory region lowers to −90 V. Since the −90 V voltage in the memory region higher than −50 V which is the developing bias voltage, and therefore, no developing electric field is formed. Accordingly, the image disturbance due to the transfer of the toner to the memory region and then to the transfer material P during the idle rotation, can be prevented.

Figure 14:
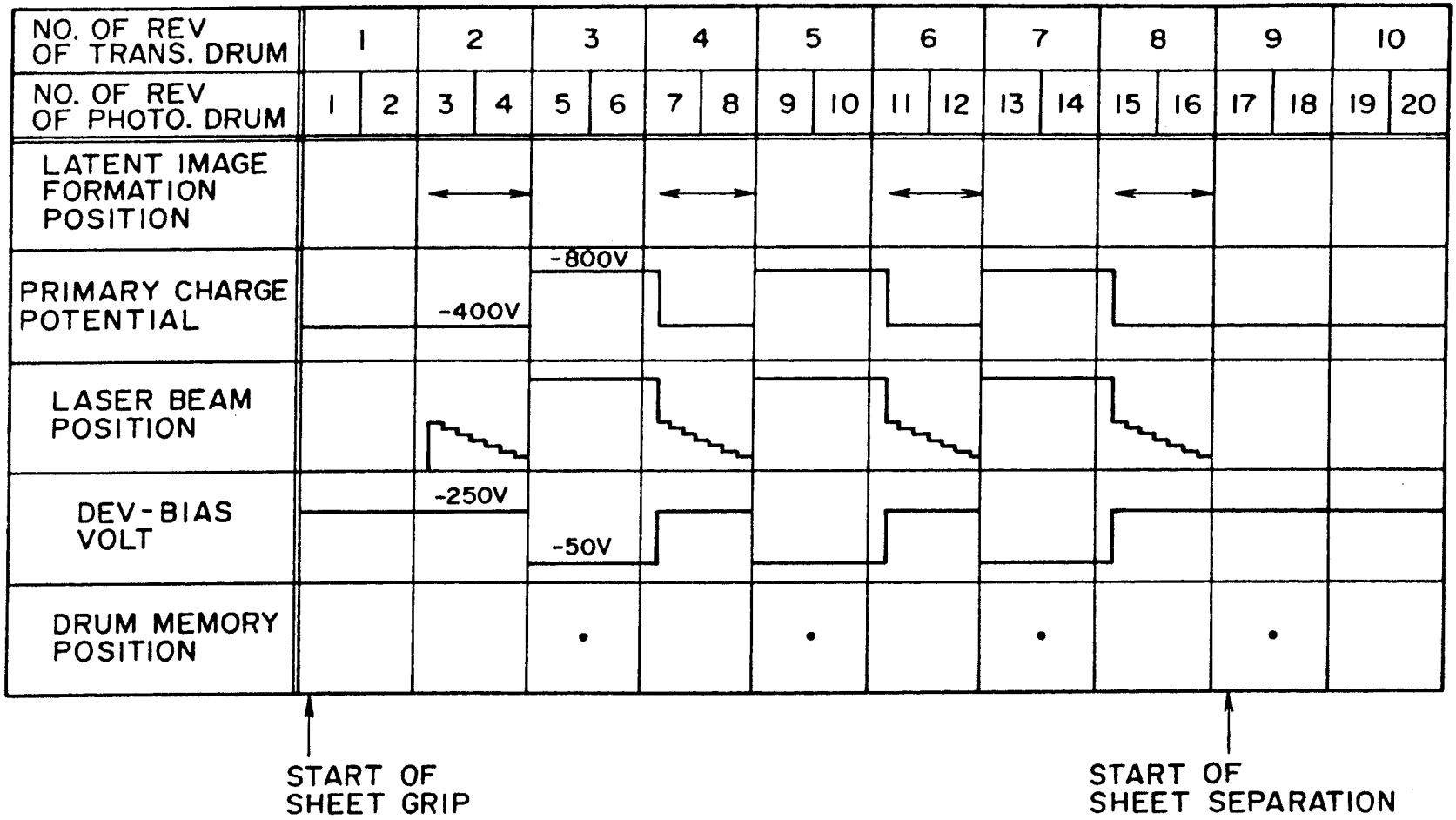
FIG. 14 illustrates operational sequence corresponding to the positions of the photosensitive drum and the transfer drum in the second embodiment of the present invention.

FIG. 14 shows sequential operations such as primary charging, laser beam exposure or the like corresponding to each rotation at the positions of the photosensitive drum and the transfer drum.

Figure 2B:
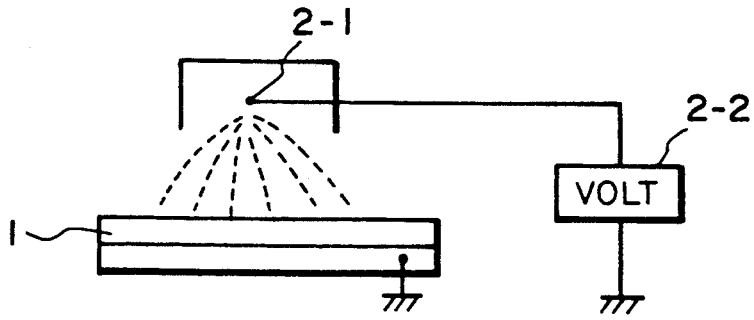
FIG. 2B is a corotron type charging means used in an image forming apparatus according to an embodiment of the present invention.

In the embodiment of FIGS. 1 and 2, the primary charger is of a scorotron type as shown in FIG. 2A, and the amount of charging of the photosensitive drum 1 is controlled by controlling the grid bias voltage for the charger. When the corotron type charger as shown in FIG. 2B is used, the voltage applied to the charging wire 2-1 is controlled to effect the same control of the charging amount for the photosensitive drum 1. In the foregoing embodiments, as shown in FIGS. 13 and 14, the amount of charge and the amount of exposure on the entirety of the latent image non-formation region of the photosensitive drum 1 is controlled to prevent the deposition of the toner on the memory region and the transfer thereof.

Figure 15:
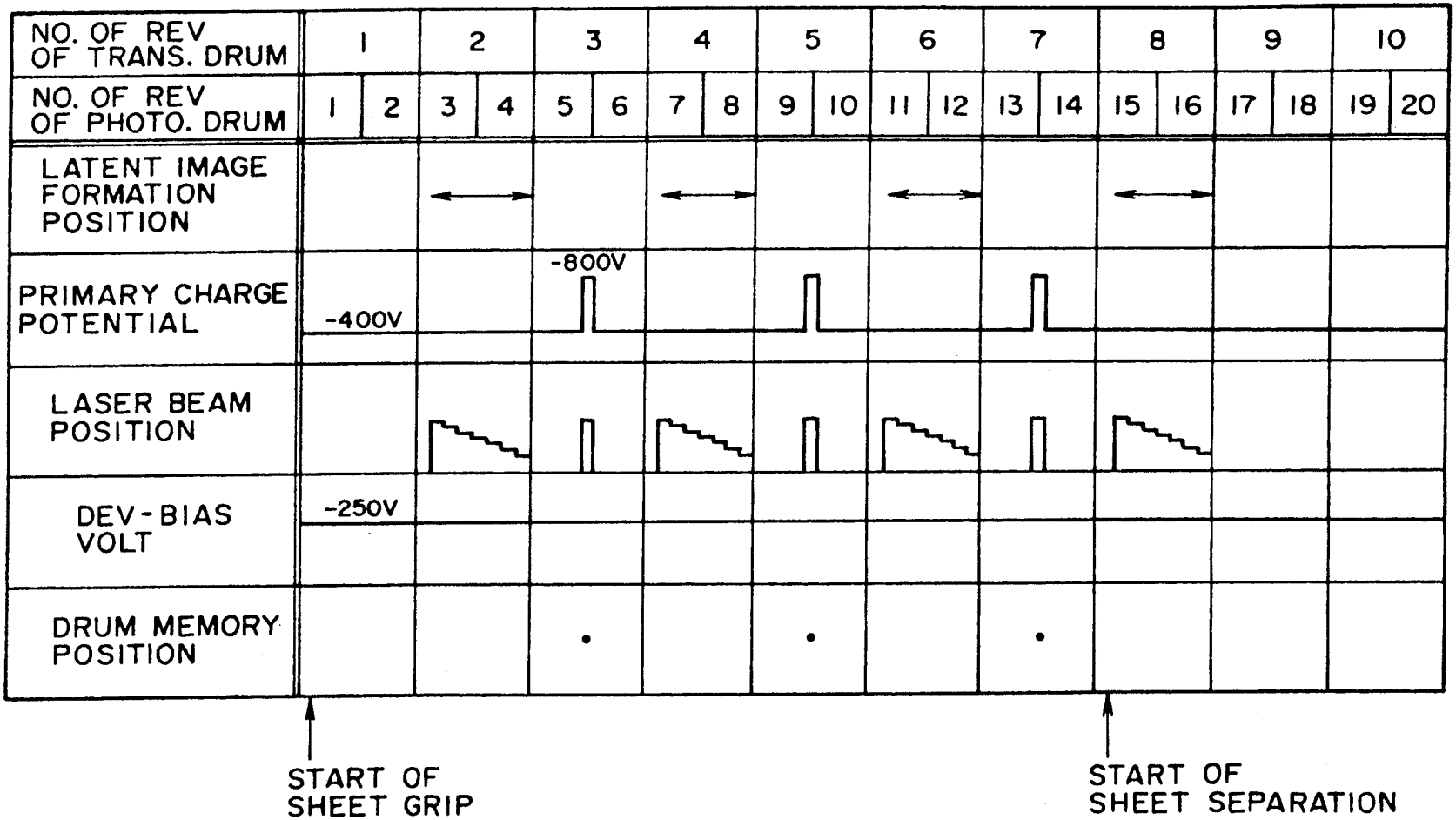
FIG. 15 illustrates operational sequence corresponding to the positions of the photosensitive drum and the transfer drum in accordance with a third embodiment of the present invention.

FIG. 15 shows a further alternative, wherein the amount of charge for the memory region is increased by the primary charger beyond that in the non-memory region of the latent image non-formation area of the photosensitive drum 1, and after the primary charging, only the memory region is uniformly exposed to light, thus preventing the formation of the developing electric field. In FIGS. 13–15, the image pattern shown in the second, fourth, sixth and eighth rotations of the transfer drum is only an example. The above described surface potential of the photosensitive drum after the primary charging, the surface potential after exposure to the laser beam, the developing bias voltage or the like in the foregoing embodiments in the latent image formation region and in the latent image non-formation region, are not limited to those exemplified. They may be properly determined by one skilled in the art in consideration of the ambient conditions or the like. The exposure means is not limited to the laser beam type exposure means, but it may be in the form of LED head or liquid crystal shutter array or the like. The present invention is applicable not only to the multi-color electrophotographic copying apparatus but also various image forming machines such as copying machines or printers.

It is a possible alternative for the purpose of reducing the memory of the photosensitive member to operate the discharging means (inside charger **5*d* and outside charger 5*e***) each time the toner image is transferred onto the transfer material P, thus electrically discharging the trailing end of the transfer material P. However, if the discharging is too strong, the toner image transfer is disturbed with the result of disturbance in the image. Therefore, it is preferable that this is incorporated in addition to the structure of the present invention.

Additionally, in order to reduce the memory, a separate charger is provided upstream of the cleaning means and downstream of the transfer means with respect to the movement direction of the surface of the photosensitive drum so as to pre-charge the memory region after the transfer process to the polarity which is the same as the polarity of the primary charging. The reduction of the memory has been confirmed. However, since the toner remaining on the photosensitive drum is also charged, the improper cleaning may occur. Additionally, the provision of the additional charger requires a high voltage source, which leads to increase of the cost, and requires additional space. Therefore, it is desirable that the memory region be charged by the primary charger provided for the image formation, as in the foregoing embodiments.

As described in the foregoing, according to the present invention, at least of a part of that region of the photosensitive member which contacts the transfer material already having the toner image, during the non-transfer action period, is charged and then exposed to light in the period between passage by the transfer position during the transfer action before the contact. Accordingly, the production of the image non-uniformity attributable to the transfer memory can be prevented.

In addition, the good images can be provided under wide varieties of ambient conditions.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a movable photosensitive member;

toner image forming means for forming a toner image on said photosensitive member;

transfer means for electrostatically transferring the toner image from said photosensitive member to a transfer material at a transfer position;

transfer material carrying means for carrying the transfer material to feed the transfer material to the transfer position, wherein said transfer means transfers the image while the transfer material is on said transfer material carrying means and while the transfer material is in first contact with said photosensitive member, and wherein after the image is transferred, the transfer material having the toner image transferred thereon and carried on the transfer material carrying means makes a second contact with said photosensitive member; and charging means for charging said photosensitive member, wherein at least a part of said photosensitive member having made the first contact is charged by said charging means before said at least a part makes the second contact, so as to be given an electric potential at which said toner image forming means does not deposit toner to said photosensitive member.

2. An apparatus according to claim 1, wherein said at least a part of the photosensitive member corresponds to a trailing edge of the transfer material.

3. An apparatus according to claim 1 or 2, wherein an amount of charge by said charging means in the at least a part of the photosensitive member is different from that in other parts of the photosensitive member.

4. An apparatus according to claim 1, wherein said charging means is a part of said toner image forming means.

5. An apparatus according to claim 1, wherein said photosensitive member has an organic photoconductive layer.

6. An apparatus according to claim 1, further comprising exposure means for exposing said photosensitive member to light, and wherein said at least a part of the photosensitive member is exposed to the light by said exposing means after it is charged by said charging means and before the second contact so that said at least a part of the photosensitive member is given an electric potential at which said toner image forming means does not deposit the toner to said photosensitive member.

7. An apparatus according to claim 6, wherein said exposure means is a part of said toner image forming means, and said exposure means exposes said photosensitive member in accordance with image information.

8. An apparatus according to claim 1 or 6, wherein a charging polarity of said transfer means and that of said charging means are opposite from each other.

9. An apparatus according to claim 8, wherein said photosensitive member has an organic photoconductive layer.

10. An apparatus according to claim 8, wherein said at least a part of said photosensitive member making the second contact is a latent image non-formation region at which no electrostatic latent image is formed before the contact.

11. An apparatus according to claim 10, wherein said charging means is a part of said toner image forming means, and an amount of charge of said at least a part of the photosensitive member by said charging means is larger than that of a latent image formation region of said photosensitive member.

12. An apparatus according to claim 8, wherein an amount of electric charge for said at least part of the photosensitive member is different from that in other parts.

13. An apparatus according to claim 12, wherein said first mentioned amount of charge is larger than the other.

14. An apparatus according to claim 13, wherein a charging polarity of said transfer means and a charging polarity of said charging means are opposite from each other, and said toner image forming means includes developing means for developing said photosensitive member with toner, wherein a bias potential applied to said developing means when said at least a part of the photosensitive member is at the developing position is higher than a potential of said at least part of the photosensitive member exposed to the light by said exposure means.

15. An apparatus according to claim 1 or 6, wherein the at least or part of the photosensitive member making the second contact is a region in which no electrostatic latent image is formed before the contact.

16. An apparatus according to claim 15, wherein said charging means is a part of said toner image forming means, and amount of charge of said at least a part of the photosensitive member by the charging means, is larger than that of a latent image formation region of said photosensitive member.

17. An apparatus according to claim 6, wherein said toner image forming means includes developing means for developing said photosensitive member with toner, and when said at least a part of the photosensitive member is at a developing position of said developing means, a bias potential applied to said developing means is such as to prevent said developing means from depositing the toner to said at least part of the photosensitive member exposed to the light by said exposure means.

18. An apparatus according to claim 17, wherein said bias potential is different from a potential applied tot he developing means during developing action.

19. An apparatus according to claim 6, wherein a charging polarity of said transfer means and a charging polarity of said charging means are opposite from each other, and said toner image forming means includes developing means for developing said photosensitive member with toner, wherein a bias potential applied to said developing means when said at least a part of the photosensitive member is at the developing position is higher than a potential of said at least part of said photosensitive member exposed to the light by said exposure means.

20. An apparatus according to claim 19, wherein the bias potential is smaller than a potential applied to said developing means during developing action thereof.

21. An apparatus according to claim 17 or 19, wherein the bias potential is the same as a potential applied to said developing means during developing operation thereof.

22. An apparatus according to claim 1 or 6, wherein said toner image forming means forms plural toner images having different colors on said photosensitive member, and the toner images are transferred superposedly by said transfer means onto the transfer material carried on said transfer material carrying means.

23. An apparatus according to claim 22, wherein a full-color image is formed on the transfer material.

24. An apparatus according to claim 1 or 6, wherein said transfer material carrying means includes a dielectric material sheet for carrying the transfer material.

25. An apparatus according to claim 6, wherein said at least a part of the photosensitive member corresponds to a trailing edge of the transfer material.

26. An apparatus according to claim 6, wherein at least a part of the photosensitive member corresponds to a trailing end portion of the transfer material in the first contact.

* * * * *

UNITED STATES PATENT AND TRADEMARK OFFICE

CERTIFICATE OF CORRECTION

PATENT NO. 5,194,901

DATED March 16, 1993

INVENTOR(S) SATORU FUKUSHIMA, ET AL.

It is certified that error appears in the above-indentified patent and that said Letters Patent is hereby corrected as shown below:

COLUMN 1

Line 36, "non-latentimage" should read --non-latent image--.

COLUMN 4

Line 54, "sheet 502" should read --sheet 501--.

COLUMN 5

Line 58, "drum 1" should read --drum 1.--.

COLUMN 6

Line 10, "amper" . should read --ampere.--.

COLUMN 7

Line 5, "voltage" should read --voltage.--.
Line 21, "charger 2" should read --charger 2.--.
Line 43, "formed" should read --formed.--.
Line 58, "region" should read --region.--.

UNITED STATES PATENT AND TRADEMARK OFFICE

CERTIFICATE OF CORRECTION

PATENT NO. 5,194,901

DATED March 16, 1993

INVENTOR(S) SATORU FUKUSHIMA, ET AL.

It is certified that error appears in the above-indentified patent and that said Letters Patent is hereby corrected as shown below:

COLUMN 8

Line 23, "exposure" should read --exposure.--.

COLUMN 9

Line 21, "region" should read --region is--.

COLUMN 11

Line 8, "the" should read --said--.

COLUMN 12

Line 4, "the" should read --said--; and "or" should read --a--.

Line 23, "tot he" should read --to the--.

Line 33, "part" should read --a part--.

Line 58, "at" should read --said at--.

Signed and Sealed this

Twenty-fifth Day of January, 1994

Bruce Lehman

*Attest:*

BRUCE LEHMAN

*Attesting Officer*

*Commissioner of Patents and Trademarks*